US012435731B1

(12) United States Patent
Hsieh et al.

(10) Patent No.: US 12,435,731 B1
(45) Date of Patent: Oct. 7, 2025

(54) CEILING FAN BLADE QUICK ASSEMBLY STRUCTURE

(71) Applicant: HOTECK INC., Taichung (TW)

(72) Inventors: Lung-Fa Hsieh, Taichung (TW); Yu-Chen Hsieh, Taichung (TW); Min-Yuan Hsiao, Taichung (TW); Ying-Pin Chiang, Taichung (TW)

(73) Assignee: HOTECK INC., Taichung (TW)

( * ) Notice: Subject to any disclaimer, the term of this patent is extended or adjusted under 35 U.S.C. 154(b) by 0 days.

(21) Appl. No.: 18/927,279

(22) Filed: Oct. 25, 2024

(30) Foreign Application Priority Data

Jul. 29, 2024 (TW) ..... 113208030

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 25/088; F04D 29/34; F04D 29/322
See application file for complete search history.

(56) References Cited

U.S. PATENT DOCUMENTS 6,309,183 B1 * 10/2001 Bucher ..... F04D 29/34 416/207
11,686,322 B1 * 6/2023 Yao ..... F04D 25/088 416/204 R
2014/0000071 A1 * 1/2014 Choi ..... F16B 2/22 24/543

* cited by examiner

*Primary Examiner* — Courtney D Heinle
*Assistant Examiner* — John S Hunter, Jr.
(74) *Attorney, Agent, or Firm* — Li & Cai Intellectual Property (USA) Office

(57) ABSTRACT

A ceiling fan blade quick assembly structure includes a blade frame, fan blades, and tenon assemblies. The blade frame includes mounting portions, each of the mounting portions includes a base plate, and positioning holes are formed on the base plate. Each fan blade has a blade body and an assembly portion. Engaging hooks are disposed on a bottom side of the assembly portion, an insertion hole is formed on one side of the engaging hooks of each assembly portion, and an engaging portion is formed adjacent to the insertion hole. An elastic buckle is disposed adjacent to each tenon assembly. The assembly portions of the fan blades are respectively disposed on the base plates of the mounting portions of the blade frame, and the engaging hooks on the bottom sides of the assembly portions are engaged with the positioning holes.

7 Claims, 8 Drawing Sheets

CEILING FAN BLADE QUICK ASSEMBLY STRUCTURE

CROSS-REFERENCE TO RELATED PATENT APPLICATION

This application claims the benefit of priority to Taiwan Patent Application No. 113208030, filed on Jul. 29, 2024. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a ceiling fan device, and more particularly to a ceiling fan blade quick assembly structure that enables a quick completion of blade assembly.

BACKGROUND OF THE DISCLOSURE

An existing ceiling fan includes a base, a motor arranged on the base, a blade frame connected to the motor, and a plurality of fan blades locked on the blade frame. When the existing ceiling fan is assembled, tools are required for locking the fan blades to a main body of the ceiling fan, and then the main body is hung from the ceiling; alternatively, the blades are installed to the main body at height. However, the ceiling fan is bulky and installation is difficult to operate at height, such that assembly is labor-intensive and time-consuming.

SUMMARY OF THE DISCLOSURE

In response to the above-referenced technical inadequacies, the present disclosure provides a ceiling fan blade quick assembly structure that enables hanging a main body first and then quickly assembling fan blades without the use of tools.

In order to solve the above-mentioned problems, one of the technical aspects adopted by the present disclosure is to provide a ceiling fan blade quick assembly structure. The ceiling fan blade quick assembly structure includes a blade frame, a plurality of fan blades, and a plurality of tenon assemblies. The blade frame includes a plurality of mounting portions, each of the mounting portions includes a base plate, a plurality of positioning holes are formed on the base plate, and the plurality of positioning holes penetrate two sides of the base plate. Each of the plurality of fan blades has a blade body and an assembly portion, and the assembly portion is connected to the blade body. A plurality of engaging hooks are disposed on a bottom side of the assembly portion, and the plurality of engaging hooks respectively correspond to the plurality of positioning holes. Each of the plurality of engaging hooks has a vertical portion and a horizontal hook portion, the horizontal hook portion is connected to the vertical portion, and the horizontal hook portion extends in a direction to be adjacent to the blade frame. At least one insertion hole is formed on one side of at least one of the plurality of engaging hooks of each of the assembly portions, and an engaging portion is formed on one side of the at least one insertion hole. An elastic buckle is disposed on one side of each of the plurality of tenon assemblies. The assembly portions of the plurality of fan blades are respectively disposed on the base plates of the plurality of mounting portions of the blade frame, and the plurality of engaging hooks on the bottom sides of the assembly portions are engaged with the corresponding positioning holes. The plurality of tenon assemblies are inserted into the corresponding one of the at least one insertion hole and the positioning holes, and the plurality of tenon assemblies abut against one side of the vertical portion of each of the engaging hooks, so that the elastic buckles of the tenon assemblies are buckled with the engaging portion on the one side of the at least one insertion hole.

Therefore, in the ceiling fan blade quick assembly structure provided by the present disclosure, the ceiling fan blade quick assembly structure includes a blade frame, a plurality of fan blades, and a plurality of tenon assemblies. The blade frame includes a plurality of mounting portions, each of the mounting portions includes a base plate, and a plurality of positioning holes are formed on the base plate. Each of the plurality of fan blades has a blade body and an assembly portion, and the assembly portion is connected to the blade body. A plurality of engaging hooks are disposed on a bottom side of the assembly portion, and the plurality of engaging hooks respectively correspond to the plurality of positioning holes. Each of the plurality of engaging hooks has a vertical portion and a horizontal hook portion. At least one insertion hole is formed on one side of at least one of the plurality of engaging hooks of each of the assembly portions, and an engaging portion is formed on one side of the at least one insertion hole. An elastic buckle is disposed on one side of each of the plurality of tenon assemblies. The assembly portions of the plurality of fan blades are respectively disposed on the base plates of the plurality of mounting portions of the blade frame, and the plurality of engaging hooks on the bottom sides of the assembly portions are engaged with the corresponding positioning holes. The plurality of tenon assemblies are inserted into the corresponding one of the at least one insertion hole and the positioning holes, and the plurality of tenon assemblies abut against one side of the vertical portion of each of the engaging hooks. Therefore, the engaging hook is prevented from moving backwards and exiting from the positioning hole, such that the engaging hook and the positioning hole are stable engaged to each other. Furthermore, the elastic buckles of the tenon assemblies are buckled with the engaging portion on the one side of the at least one insertion hole, such that a quick and tool-free assembly can be achieved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
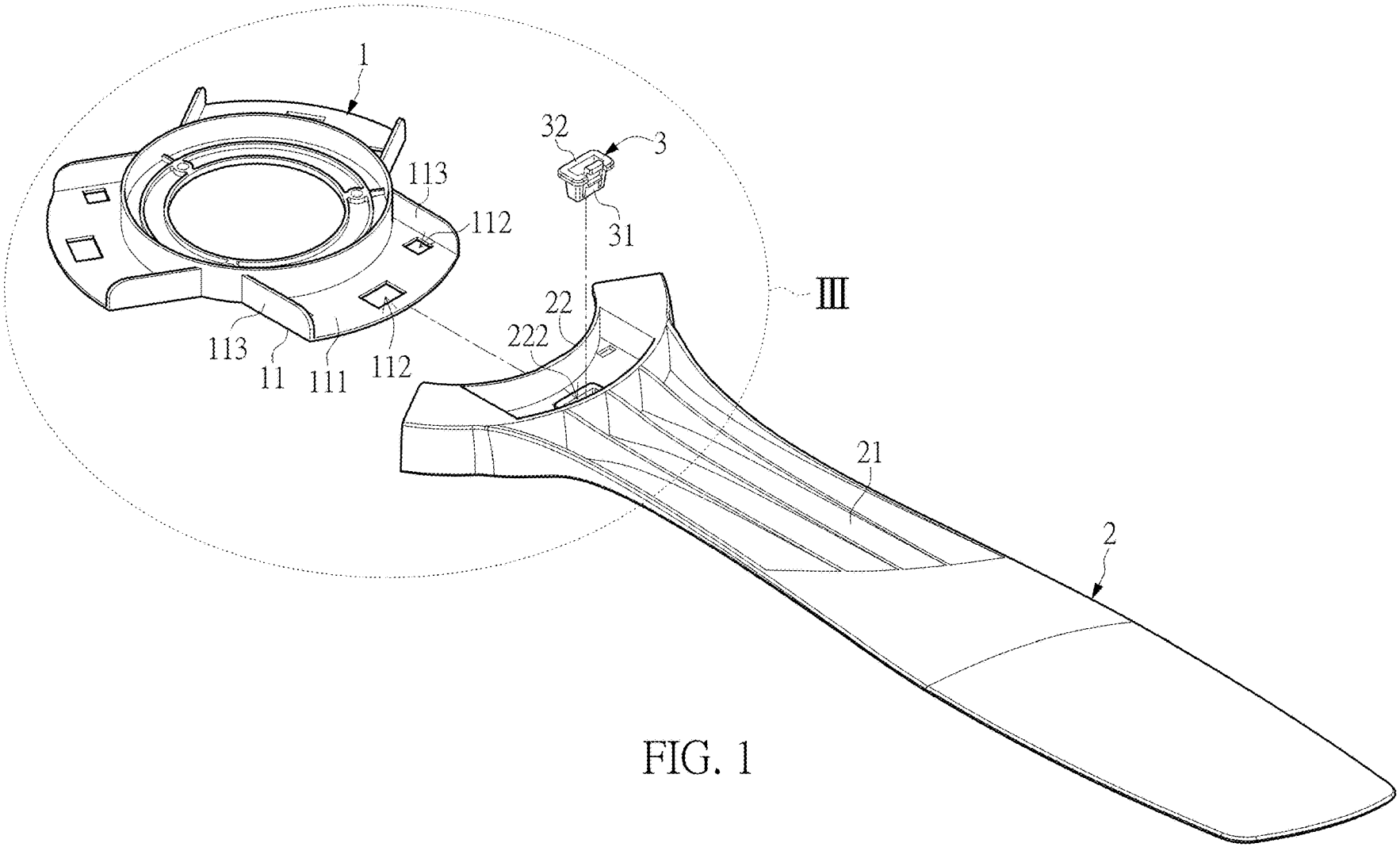
FIG. 1 is a schematic perspective exploded view of a ceiling fan blade quick assembly structure according to one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

Embodiments

Figure 2:
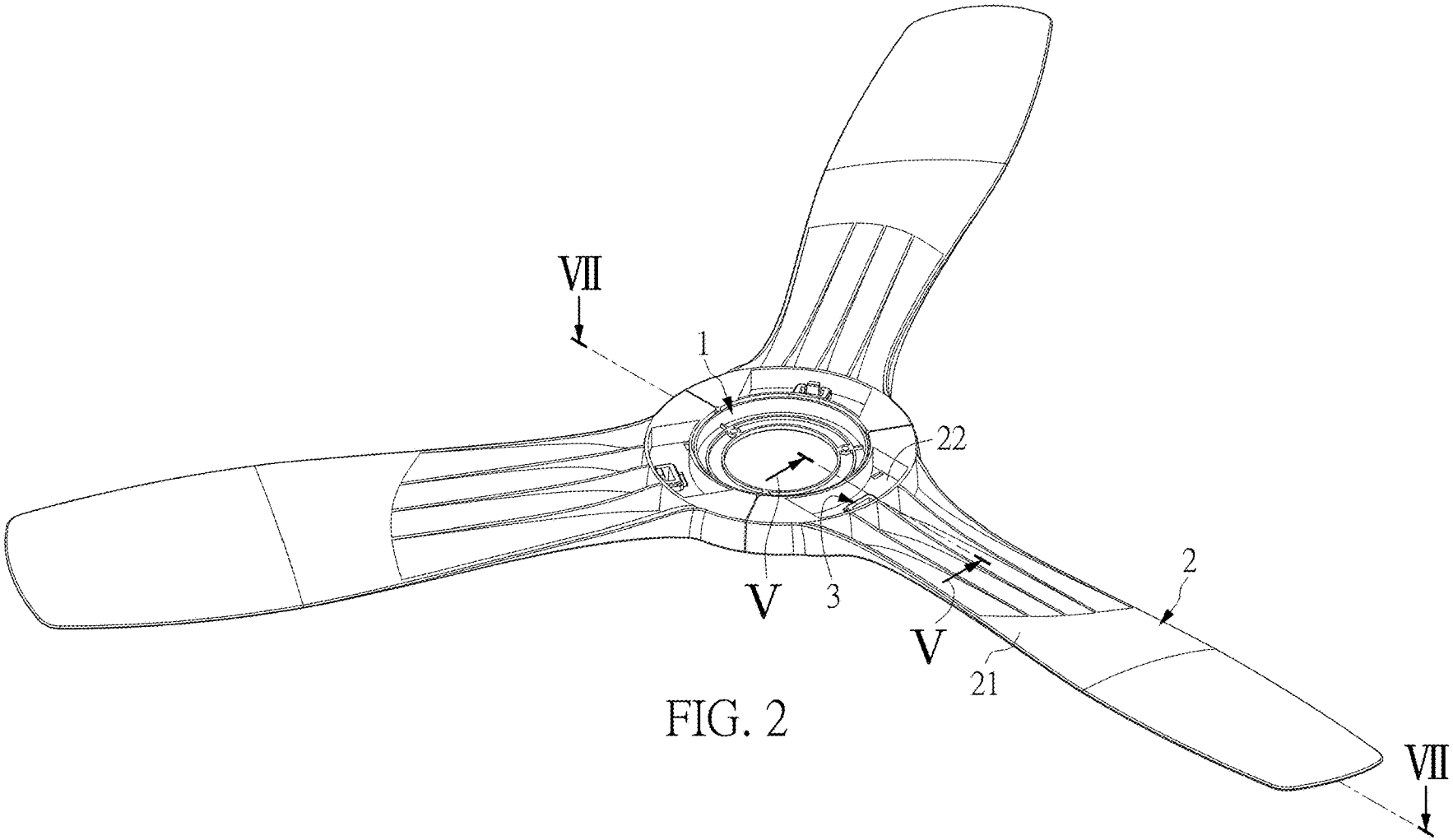
FIG. 2 is a schematic perspective view of the ceiling fan blade quick assembly structure according to one embodiment of the present disclosure.

Referring to FIG. 1 and FIG. 2, the present disclosure provides a ceiling fan blade quick installation structure that includes a blade frame 1, a plurality of fan blades 2, and a plurality of tenon assemblies 3.

The blade frame 1 is fixedly disposed on the motor, and the blade frame 1 includes a plurality of mounting portions 11. The number of the mounting portions 11 is not limited and can be changed corresponding to the quantity of the fan blades 2. Each of the mounting portions 11 includes a base plate 111, and a plurality of positioning holes 112 are formed on the base plate 111. The positioning holes 112 can be quadrilateral holes, but the shape of the positioning holes 112 is not limited. The positioning holes 112 penetrate two sides of the base plate 111. In this embodiment, three positioning holes 112 are formed on the base plate 111 of each of the mounting portions 11, and the three positioning holes 112 are respectively formed in a middle position and two side positions of the base plate 111. However, the number and position of the positioning holes 112 are not limited herein. Each of the mounting portions 11 may include two side plates 113 that are respectively connected and erected from two sides of the base plate 111, such that each of the mounting portions 11 can form a U-shaped structure to increase strength and more stably support the fan blade 2.

Figure 7:
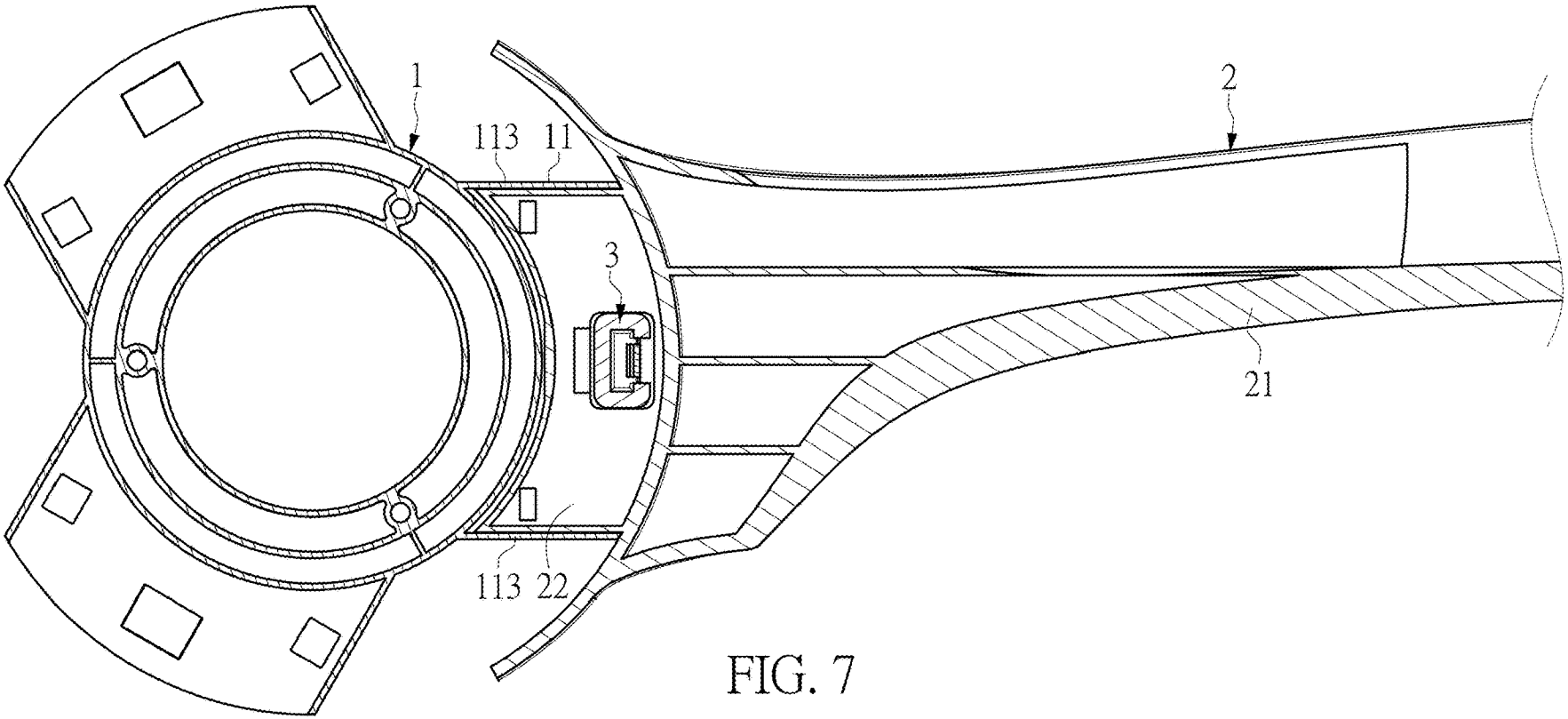
FIG. 7 is a schematic cross-sectional view taken along line VII-VII of FIG. 2.
Figure 8:
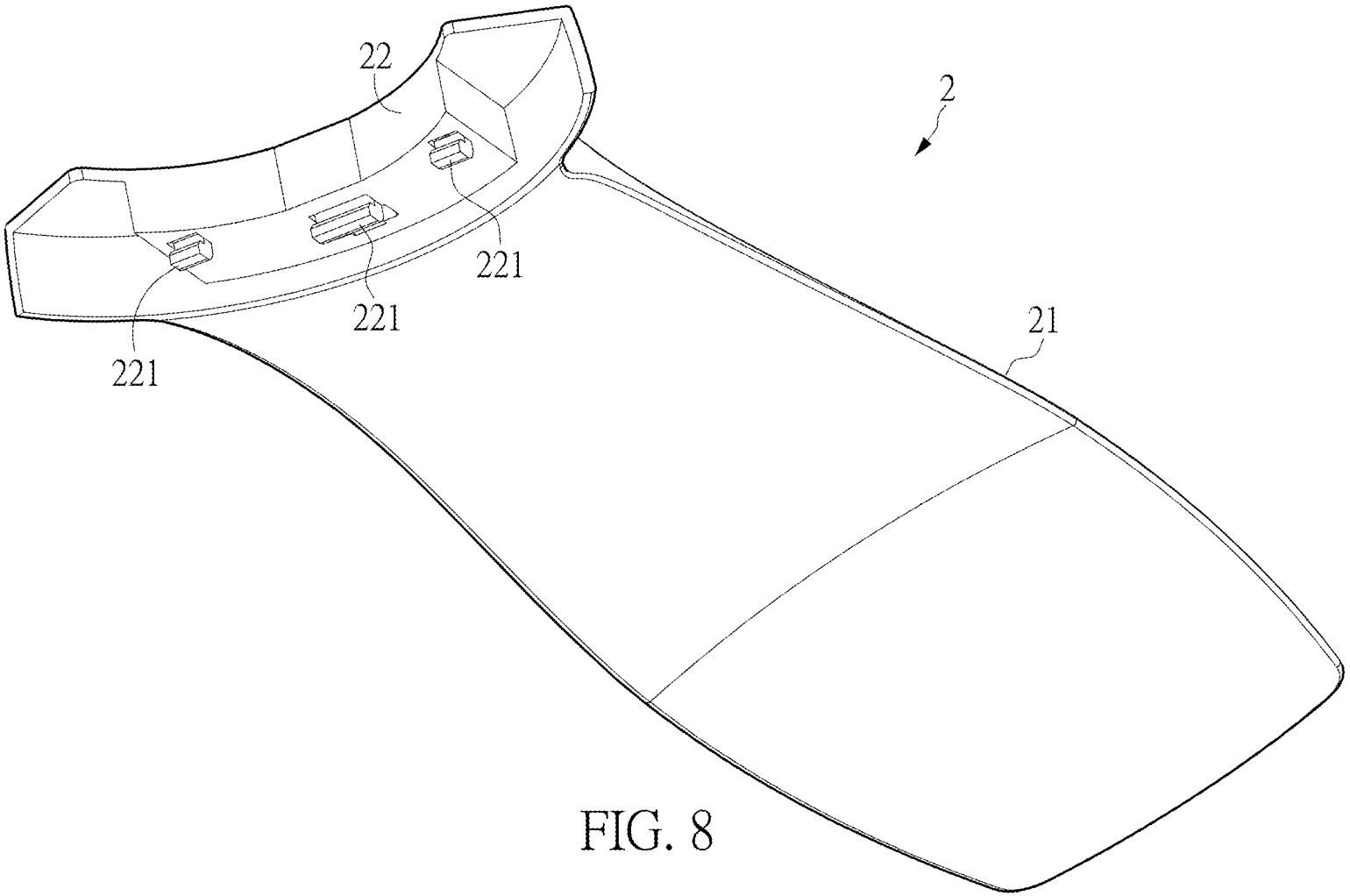
FIG. 8 is a perspective view of a fan blade according to one embodiment of the present disclosure.

Each of the plurality of fan blades 2 has a blade body 21 and an assembly portion 22, and the assembly portion 22 is connected to one end of the blade body 21. The shape of the assembly portion 22 matches with the mounting portion 11, such that the assembly portion 22 of the fan blade 2 can be disposed on the mounting portion 11 of the blade frame 1. In this embodiment, the assembly portion 22 of the fan blade 2 is in the form of an arc-shaped shell (as shown in FIG. 7 and FIG. 8), and can be disposed on the mounting portion 11 having an arc-shaped base body, so as to form an optimal matching. Furthermore, the assembly portion 22 of the fan blade 2 can be positioned between the base plate 111 and the two side plates 113 of the mounting portion 11, such that the assembly portion 22 of the fan blade 2 is firmly positioned on the mounting portion 11 of the blade frame 1. Preferably, two sides of the assembly portion 22 of the fan blade 2 are flat and parallel to each other, and the two side plates 113 of the mounting portion 11 are flat and parallel to each other. Accordingly, two sides of the assembly portion 22 of the fan blade 2 can be flatly attached to the two side plates 113 of the mounting portion 11, such that the assembly portion 22 of the fan blade 2 is firmly connected with the mounting portion 11 of the blade frame 1, thereby enabling the assembly portion 22 of the fan blade 2 to be accurately positioned on the mounting portion 11 of the blade frame 1.

Figure 3:
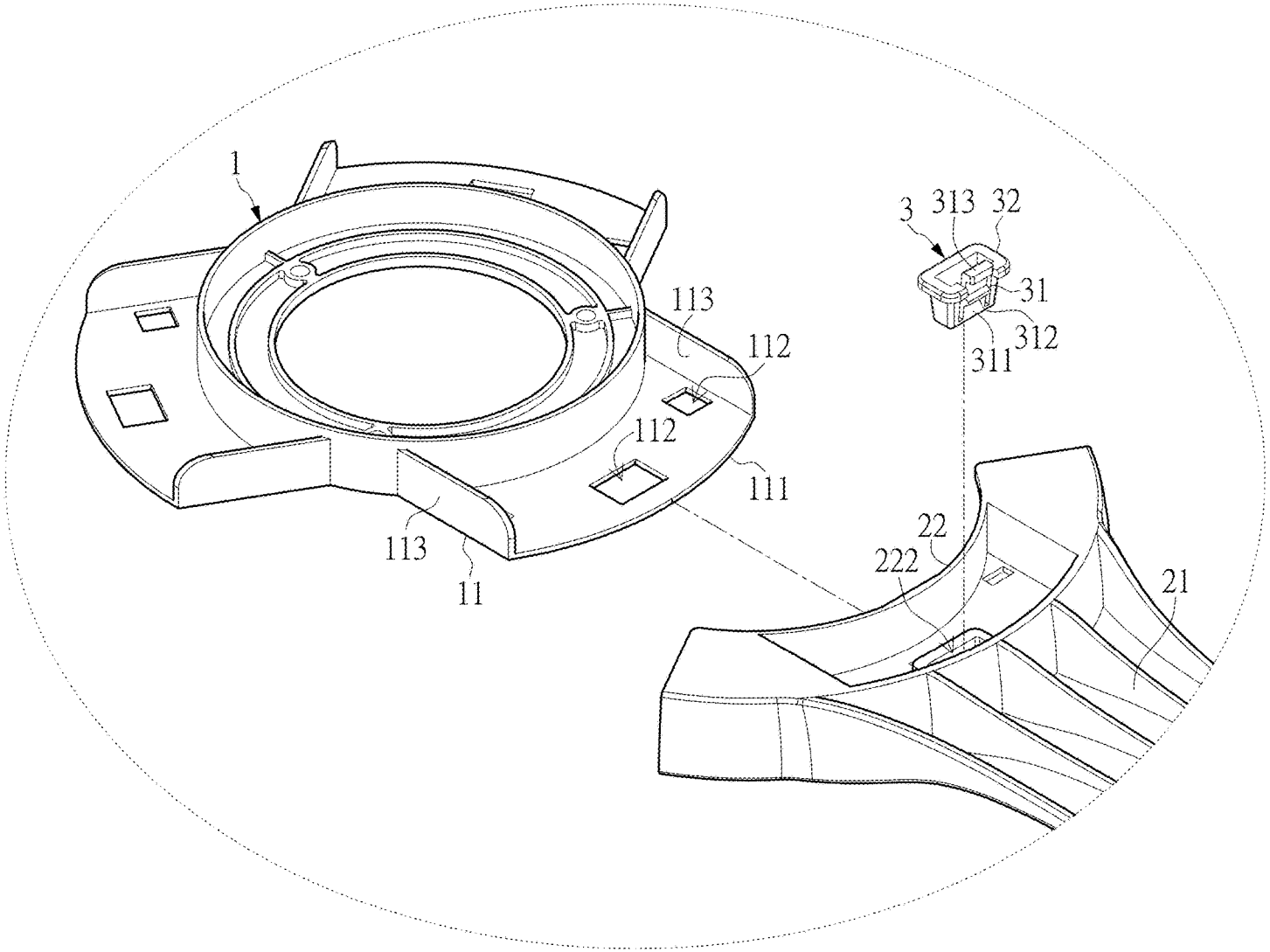
FIG. 3 is a detailed view of part III of FIG. 1.
Figure 4:
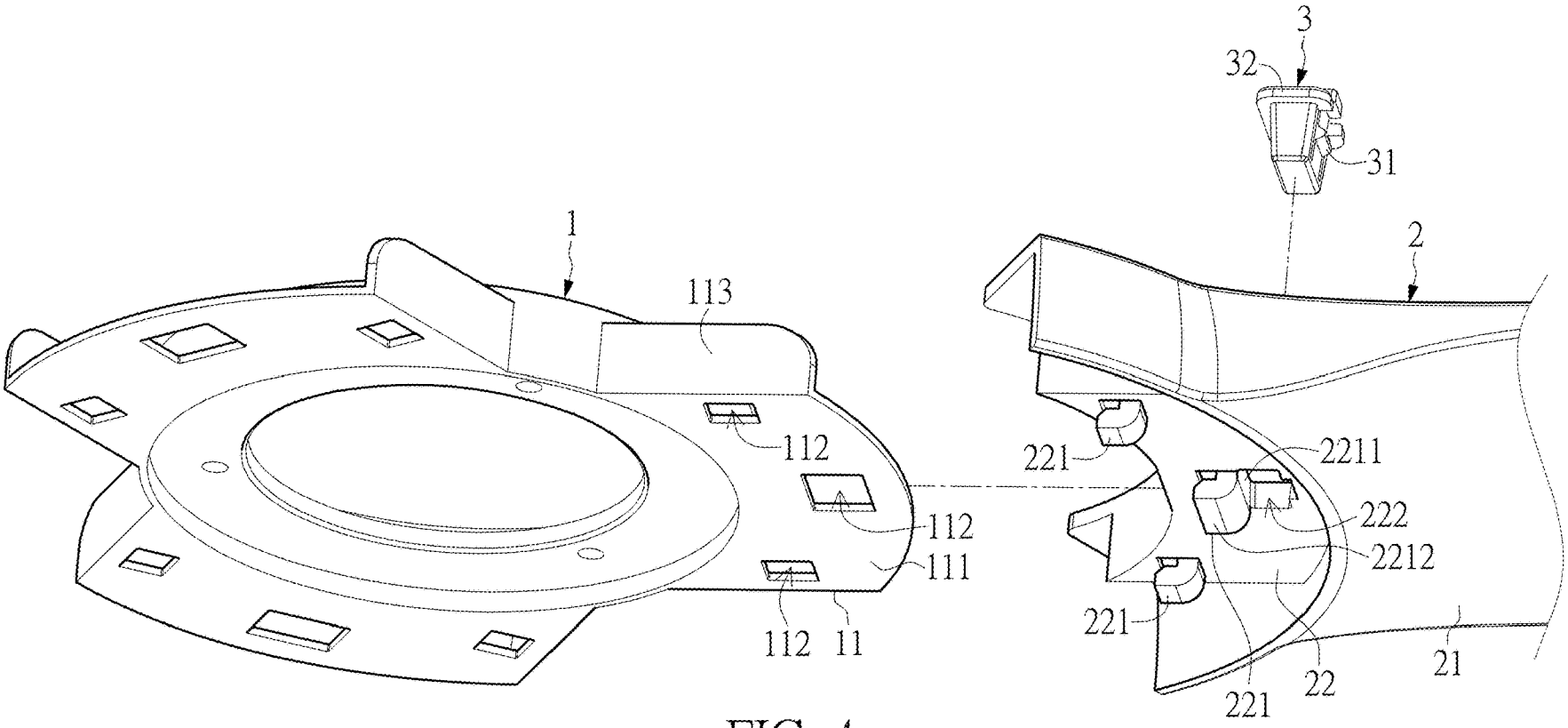
FIG. 4 is a another schematic perspective view of FIG. 3.
Figure 5:
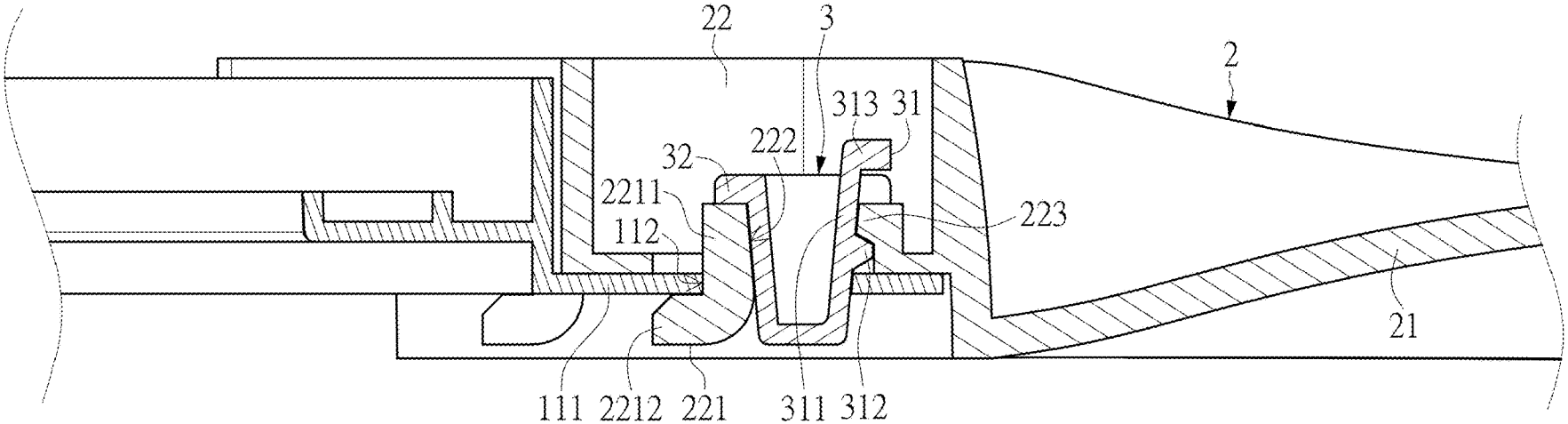
FIG. 5 is a schematic cross-sectional view taken along line V-V of FIG. 2.

A plurality of engaging hooks 221 are disposed on the bottom side of the assembly portion 22 (as shown in FIG. 3 to FIG. 5). The plurality of engaging hooks 221 respectively correspond to the plurality of positioning holes 112. After the engaging hooks 221 pass through the positioning holes 112, the engaging hooks 221 can be pushed forward along a direction towards the axis of the blade frame 1, such that the engaging hooks 221 can be locked with the positioning holes 112, respectively. In this embodiment, three engaging hooks 221 are provided on the bottom side of each of the assembly portions 22. The three engaging hooks 221 are respectively disposed in a middle position and two side positions of the bottom side of the assembly portion 22, such that the engaging hooks 221 have an improved snapping effect, but the number and position of the engaging hooks 221 are not limited herein.

Each of the engaging hooks 221 has a vertical portion 2211 and a horizontal hook portion 2212. The vertical portion 2211 is arranged upright, the horizontal hook portion 2212 is connected to a lower end of the vertical portion 2211, and the horizontal hook portion 2212 extends in a direction towards the blade frame 1, such that the engaging hook 221 can be pushed forward after passing through the positioning hole 112, thereby enabling the horizontal hook portion 2212 to be locked on the bottom side of the base plate 111.

At least one insertion hole 222 is formed on one side of at least one of the plurality of engaging hooks 221 of each of the assembly portions 22. In this embodiment, an insertion hole 222 is formed on one side of the engaging hook 221 located in the middle position of each of the assembly portions 22. The insertion hole 222 is a top-down perforation. The insertion hole 222 can be a quadrilateral hole, the insertion hole 222 can have a taper, and the insertion hole 222 tapers from top to bottom to match with the tenon assembly 3, thereby allowing the tenon assembly 3 to be smoothly inserted into the insertion hole 222. An engaging portion 223 is formed on one side of the insertion hole 222.

The number of the tenon assemblies 3 can be changed corresponding to the number of the fan blades 2. In this embodiment, the tenon assemblies 3 can be in a quadrilateral shape, the tenon assemblies 3 can be tapered, and each of the tenon assemblies 3 tapers from top to bottom, such that the tenon assembly 3 can be smoothly inserted into a corresponding insertion hole 222.

Figure 6:
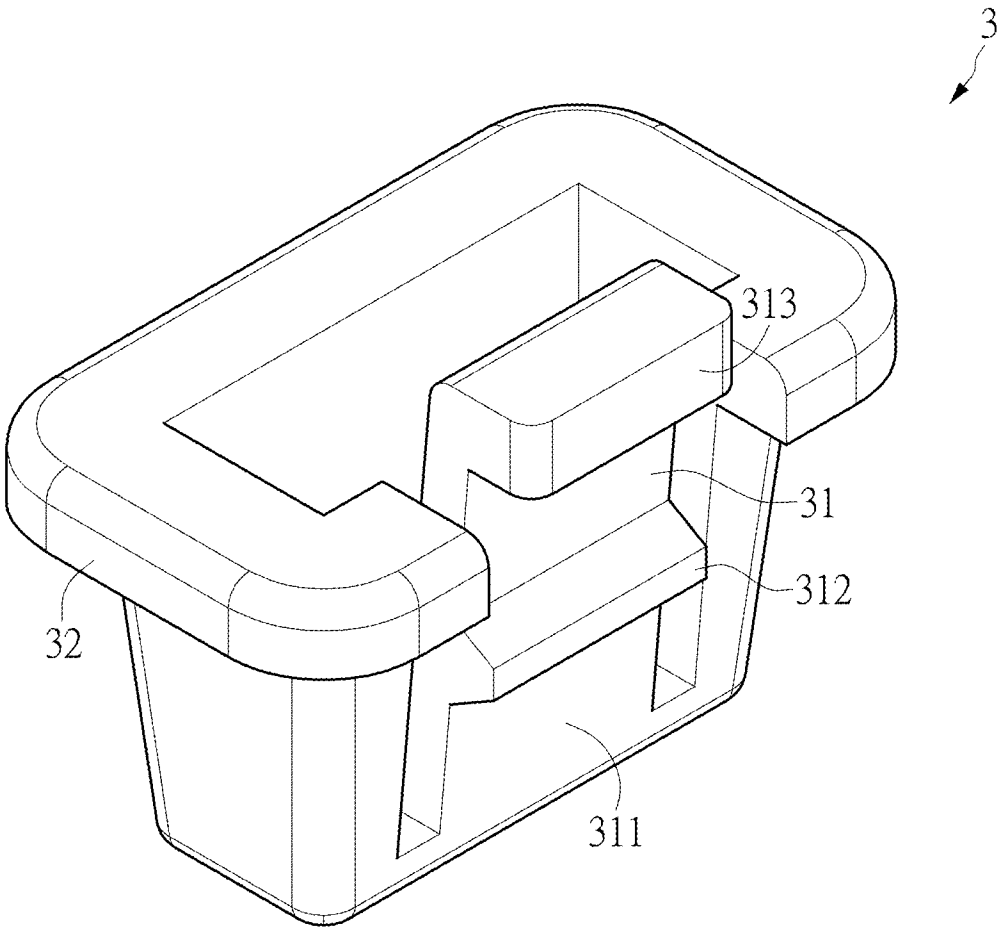
FIG. 6 is a schematic perspective view of a tenon assembly according to one embodiment of the present disclosure.

An elastic buckle 31 is provided on one side of the tenon assembly 3 (as shown in FIG. 6). The elastic buckle 31 has an elastic arm 311, a protrusion 312, and a pulling tab 313. One end of the elastic arm 311 is a fixed end, and another end of the elastic arm 311 is a movable end. The protrusion 312 is located on the elastic arm 311, and the pulling tab 313 is located on the movable end of the elastic arm 311, such that the elastic buckle 31 can swing in a front-rear manner.

When the tenon assembly 3 is inserted into the insertion hole 222 and the positioning hole 112, the protrusion 312 engages with the engaging portion 223 on the one side of the insertion hole 222 to prevent the tenon assembly 3 from exiting from the insertion hole 222 and the positioning hole 112. The pulling tab 313 can also be used to pull the elastic buckle 31 to swing, such that the protrusion 312 can be separated from the engaging portion 223, so as to facilitate the disassembly of the tenon assembly 3.

In this embodiment, an upper end of the tenon assembly 3 further has a flange 32. The flange 32 is arranged at a periphery of the upper end of the tenon assembly 3 and protrudes outward. When the tenon assembly 3 is inserted into the corresponding insertion hole 222 and the positioning hole 112, the flange 32 abuts against an upper edge of the insertion hole 222 to provide a blocking and positioning function, such that the tenon assembly 3 is positioned stably.

When the assembly portion 22 is disposed on the base plate 111 and the plurality of engaging hooks 221 on the bottom side of the assembly portion 22 are engaged with the corresponding positioning holes 112, each of the tenon assemblies 3 can be inserted into the corresponding insertion hole 222, such that the tenon assembly 3 can abut against one side of the vertical portion 2211 of the engaging hook 221 (as shown in FIG. 5), and the elastic buckle 31 of the tenon assembly 3 is engaged with the engaging portion 223 on the one side of the insertion hole 222.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A ceiling fan blade quick assembly structure, comprising:

a blade frame including a plurality of mounting portions, wherein each of the mounting portions includes a base plate, a plurality of positioning holes are formed on the base plate, and the plurality of positioning holes penetrate two sides of the base plate;

a plurality of fan blades, wherein each of the plurality of fan blades has a blade body and an assembly portion, and the assembly portion is connected to the blade body; wherein a plurality of engaging hooks are disposed on a bottom side of the assembly portion, and the plurality of engaging hooks respectively correspond to the plurality of positioning holes; wherein each of the plurality of engaging hooks has a vertical portion and a horizontal hook portion, the horizontal hook portion is connected to the vertical portion, and the horizontal hook portion extends in a direction towards the blade frame; wherein at least one insertion hole is formed on one side of at least one of the plurality of engaging hooks of each of the assembly portions, and an engaging portion is formed on one side of the at least one insertion hole; and a plurality of tenon assemblies, wherein an elastic buckle is disposed on one side of each of the plurality of tenon assemblies; wherein the elastic buckle has an elastic arm, a protrusion, and a pulling tab, one end of the elastic arm is a fixed end, and another end of the elastic arm is a movable end; wherein the protrusion is located on the elastic arm, and the pulling tab is located on the movable end of the elastic arm, so that the protrusion is engaged with the engaging portion on the one side of the corresponding insertion hole;

wherein the assembly portions of the plurality of fan blades are respectively disposed on the base plates of the plurality of mounting portions of the blade frame, and the plurality of engaging hooks on the bottom sides of the assembly portions are engaged with the corresponding positioning holes; wherein the plurality of tenon assemblies are inserted into the corresponding one of the at least one insertion hole and the positioning holes, and the plurality of tenon assemblies abut against one side of the vertical portion of each of the engaging hooks, so that the elastic buckles of the tenon assemblies are buckled with the engaging portion on the one side of the at least one insertion hole.

2. The ceiling fan blade quick assembly structure according to claim 1, wherein each of the mounting portions includes two side plates, the two side plates are respectively connected to two sides of the base plate, and the two side plates are respectively erected from the two sides of the base plate, so that the assembly portion of a corresponding one of the plurality of fan blades is positioned between the base plate and the two side plates of each of the mounting portions.

3. The ceiling fan blade quick assembly structure according to claim 1, wherein each of the assembly portions of the fan blades is in the form of an arc-shaped shell, and each of the mounting portions of the blade frame is in the form of an arc-shaped base body.

4. The ceiling fan blade quick assembly structure according to claim 1, wherein the insertion hole is a top-down perforation, the insertion hole is a tapered quadrilateral hole, and the insertion hole tapers from top to bottom; wherein each of the tenon assemblies is quadrilateral-shaped and tapered, and each of the tenon assemblies tapers from top to bottom, so that each of the tenon assemblies matches with the corresponding insertion hole.

5. The ceiling fan blade quick assembly structure according to claim 1, wherein a lower end of the elastic arm is the fixed end, an upper end of the elastic arm is the movable end, and the pulling tab is disposed on the upper end of the elastic arm.

6. The ceiling fan blade quick assembly structure according to claim 1, wherein three of the positioning holes are formed on the base plate of each of the mounting portions, and the three positioning holes are respectively formed in a middle position and two side positions of the base plate; wherein three of the engaging hooks are disposed on the bottom side of each of the assembly portions, the three engaging hooks are respectively disposed in a middle position and two side positions of the bottom side of the assembly portion, and the insertion hole is formed on one side of the engaging hook disposed in the middle position of the assembly portion.

7. A ceiling fan blade quick assembly structure, comprising:

a blade frame including a plurality of mounting portions, wherein each of the mounting portions includes a base plate, a plurality of positioning holes are formed on the base plate, and the plurality of positioning holes penetrate two sides of the base plate;

a plurality of fan blades, wherein each of the plurality of fan blades has a blade body and an assembly portion, and the assembly portion is connected to the blade body; wherein a plurality of engaging hooks are disposed on a bottom side of the assembly portion, and the plurality of engaging hooks respectively correspond to the plurality of positioning holes; wherein each of the plurality of engaging hooks has a vertical portion and a horizontal hook portion, the horizontal hook portion is connected to the vertical portion, and the horizontal hook portion extends in a direction towards the blade frame; wherein at least one insertion hole is formed on one side of at least one of the plurality of engaging hooks of each of the assembly portions, and an engaging portion is formed on one side of the at least one insertion hole; and a plurality of tenon assemblies, wherein an elastic buckle is disposed on one side of each of the plurality of tenon assemblies;

wherein the assembly portions of the plurality of fan blades are respectively disposed on the base plates of the plurality of mounting portions of the blade frame, and the plurality of engaging hooks on the bottom sides of the assembly portions are engaged with the corresponding positioning holes; wherein the plurality of tenon assemblies are inserted into the corresponding one of the at least one insertion hole and the positioning holes, and the plurality of tenon assemblies abut against one side of the vertical portion of each of the engaging hooks, so that the elastic buckles of the tenon assemblies are buckled with the engaging portion on the one side of the at least one insertion hole;

wherein an upper end of each of the tenon assemblies has a flange, and the flange is arranged at a periphery of the upper end of the tenon assembly and protrudes outward; wherein, when the tenon assembly is inserted into the corresponding insertion hole and the positioning hole, the flange abuts against an upper edge of the insertion hole.

* * * * *